US008131184B2

(12) United States Patent
Deguchi

(10) Patent No.: US 8,131,184 B2
(45) Date of Patent: Mar. 6, 2012

(54) CHARGING DEVICE WITH VIBRATING GRID ELECTRODE AND IMAGE FORMING APPARATUS

(75) Inventor: Masanobu Deguchi, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 551 days.

(21) Appl. No.: 12/349,638

(22) Filed: Jan. 7, 2009

(65) Prior Publication Data

US 2009/0175655 A1 Jul. 9, 2009

(30) Foreign Application Priority Data

Jan. 9, 2008 (JP) ..... P2008-002636

(51) Int. Cl.
*G03G 15/02* (2006.01)

(52) U.S. Cl. ..... 399/171; 399/115; 399/168; 399/170; 399/172; 399/173

(58) Field of Classification Search ..... 399/115, 399/168, 170–173
See application file for complete search history.

(56) References Cited

U.S. PATENT DOCUMENTS

| | | | | |
|---|---|---|---|---|
| 4,237,399 | A * | 12/1980 | Sakamoto | 310/317 |
| 4,367,948 | A * | 1/1983 | Suzuki | 399/48 |
| 4,680,669 | A | 7/1987 | Tsuchiya et al. | |

FOREIGN PATENT DOCUMENTS

| | | | |
|---|---|---|---|
| JP | 59-136751 | A | 8/1984 |
| JP | 63-292167 | | 11/1988 |
| JP | 11-040316 | | 2/1999 |
| JP | 2001-166569 | | 6/2001 |
| JP | 2001-272848 | A | 10/2001 |
| JP | 2004-004334 | | 1/2004 |

* cited by examiner

*Primary Examiner* — Ryan Walsh
(74) *Attorney, Agent, or Firm* — Nixon & Vanderhye P.C.

(57) ABSTRACT

In a plate-like grid electrode of a charging device that controls the charged potential of a surface of a photoreceptor drum, a vibrating portion that vibrates itself to make the plate-like grid electrode vibrate is formed. The vibrating portion is a piezoelectric bimorph element in which two piezoelectric elements are bonded to each other and a base portion is provided between the two piezoelectric elements. When a voltage is applied to the piezoelectric bimorph element, a free end is curved to vibrate the piezoelectric bimorph element.

14 Claims, 6 Drawing Sheets

CHARGING DEVICE WITH VIBRATING GRID ELECTRODE AND IMAGE FORMING APPARATUS

CROSS-REFERENCE TO RELATED APPLICATION

This application claims priority to Japanese Patent Application No. 2008-002636, which was filed on Jan. 9, 2008, the contents of which are incorporated herein by reference in its entirety.

BACKGROUND OF THE INVENTION

1. Field of the Invention

The present invention relates to a corona charging type charging device and an image forming apparatus.

2. Description of the Related Art

In electrophotographic image forming apparatuses, such as a copying machine, a printer, and a facsimile, an image is formed on recording paper by uniformly charging a surface of a photoreceptor, which serves as an image carrier and has a photosensitive layer including a photoconductive material formed on the surface, with electric charges applied, forming an electrostatic latent image corresponding to image information by various image creating processes, developing the electrostatic latent image with a developer supplied from a developing section and containing toner to thereby form a visual image, transferring the visual image onto a recording material such as paper, and heating and pressing the recording material using a developing roller in order to fix the visual image to the recording paper.

In such an image forming apparatus, a charging device is typically used to make the surface of the photoreceptor, electrically charged. Charging devices are classified into: a non-contact type charging device including a discharge electrode used to perform corona discharge onto a photoreceptor, a grid electrode that is an electrode which is provided between a surface of the photoreceptor and the discharge electrode as needed and which controls the amount of electric charges applied to the surface of the photoreceptor by the discharge electrode and the charged potential of the surface of the photoreceptor, and a support member that supports the discharge electrode and the grid electrode; and a contact type charging device that uses a charged roller or a charging brush. Since the grid electrode can control the charged potential of the surface of the photoreceptor almost correctly, the non-contact type charging device in which the grid electrode is provided is mainly used in an image forming apparatus that needs high speed.

As examples of the discharge electrode which performs corona discharge, a wire electrode, a metal plate electrode (hereinafter, referred to as a 'needle-like electrode') having a plurality of needle-like portions, and the like are used. Among these examples, the needle like electrode which is advantageous in that its number of constituent components is small, it has a long life, the amount of ozone generated is small, and few failures occur since an open circuit does not easily occur is preferably used. The needle-like electrode is manufactured by etching a metal plate mainly formed of an iron-based metal material, such as stainless steel, to form a plurality of needle-like portions. The iron-based metal material, such as stainless steel, which is a material of the needle-like electrode has high durability but has disadvantages that the iron-based metal material is easily oxidized by the moisture under a high-humidity environment, a nitrogen oxide or ozone generated by corona discharge at the time of charging operation, and the like.

In order to solve such a problem, it was proposed to provide a cover layer on a needle-like electrode surface. For example, Japanese Unexamined Patent Publication JP-A 2004-4334 proposes a charging device including a needle-like electrode with a surface on which a cover layer, which is formed of gold, platinum, copper, nickel, or chromium by plating processing, is formed. The needle-like electrode is manufactured by methods, such as etching processing and precision press. A processed section of the needle-like electrode manufactured by such methods is not sufficiently smooth and accordingly, fine uneven portions are generated. Such fine uneven portions also remain in the needle-like electrode having a cover layer formed by plating processing that is disclosed in JP-A 2004-4334. In the needle-like electrode with fine uneven portions, the applied voltage controllability which is the controllability of a voltage applied to the needle-like electrode is degraded, which disturbs the balance of corona discharge. This makes the charged potential of the surface of the photoreceptor uneven. In addition, contaminants, such as fine toner, easily adhere to the fine uneven portions formed in the needle-like electrode. That is, the needle-like electrode disclosed in JP-A 2004-4334 is disadvantageous in that the applied voltage controllability of the needle-like electrode is further degraded since contaminants, such as fine toner, adhere to the needle-like electrode by long-terra use, which makes the charged potential of the surface of the photoreceptor more uneven.

On the other hand, a wire grid electrode formed of stainless steel or tungsten, a perforated plate-like grid electrode having a plurality of through holes formed in a metal plate (grid base) formed of stainless steel, and the like are used as the grid electrode. Similar to the case of the needle-like electrode, the iron-based metal material, such as stainless steel, which is a material of the grid electrode has high durability but has disadvantages that the iron-based metal material is easily oxidized by the moisture under a high-humidity environment, a nitrogen oxide or ozone generated by corona discharge at the time of charging operator, and the like. In addition, in the case of using the grid electrode for a long period of time, the use under the high-humidity environment, the contact with ozone or a nitrogen oxide, and the like are unavoidable. For this reason, in the grid electrode formed of a metallic material, such as stainless steel, corrosion, such as rust, occurs due to the moisture in the air, ozone, or a nitrogen oxide. This lowers the durability. Furthermore, since the controllability of the charged potential of the surface of the photoreceptor becomes insufficient, the charged potential of the surface of the photoreceptor becomes uneven. Accordingly, a desired charged potential cannot be stably applied to the surface of the photoreceptor all the time. In addition, also in the case of the wire electrode, there is a problem that corrosion, such as rust, occurs in the grid electrode due to the ozone generated by corona discharge and the charged potential of the surface of the photoreceptor becomes uneven, which should be solved.

In view of the above problems in the charging device, for example, Japanese Unexamined Patent Publication JP-A 11-40316 (1999) proposes a charging device including a wire electrode, which is provided to extend inside a shielding case having one opened surface, and a plate-like grid electrode disposed between the wire electrode and a photoreceptor, the plate-like grid electrode being obtained by forming a nickel-plated layer with a thickness of about 1 μm on a surface of a perforated plate made of stainless steel and then forming a gold-plated layer with a thickness of about 0.3 μm on the nickel-plated layer. Since the gold-plated layer is formed on the nickel-plated layer in the plate-like grid electrode disclosed in JP-A 11-40316, the gold-plated layer does not peel easily and the corrosion resistance and the controllability of the charged potential of the surface of the photoreceptor are relatively good. However, since it is necessary to perform plating processing twice, that is, nickel plating processing and gold plating processing, in order to manufacture the plate-like grid electrode, the manufacturing process is complicated, which causes a problem that the cost is increased.

Furthermore, in order to sufficiently realize the above preferable characteristics in the plate-like grid electrode, the thickness of the gold-plated layer needs to be set to 0.3 μm or more. In addition, since the plate-like grid electrode is a relatively large member having almost the same size as the photoreceptor, the plated layer should be made thick. Accordingly, the amount of gold used also increases inevitably. Such heavy use of gold raises the price of a charging device and the price of an image forming apparatus, which impairs the versatility-based on a relatively-low price that is one of the advantages of the image forming apparatus. Therefore, a charging device which is excellent in the durability and the controllability of the charged potential of the surface of the photoreceptor without using an expensive material, such as gold, is desired.

Furthermore, Japanese Unexamined Patent Publication JP-A 2001-166569 proposes a charging device including a wire electrode and a plate-like grid electrode which is obtained by forming a gold-plated layer directly on a surface of a metal plate made of stainless steel using an electroplating method using a pulse current. Since the gold-plated layer does not peel easily either similar to the plate-like grid electrode disclosed in JP-A 11-40316, the corrosion resistance is high and the controllability of the charged potential of a surface of a photoreceptor is also good. However, in the plate-like grid electrode, there is also the same disadvantage as in the charging device disclosed in JP-A 11-40316 since it is necessary to set the thickness of the gold-plated layer to be 0.3 μm or more.

In addition, when analyzing the phenomenon in which corrosion, such as rust, occurs in the grid electrode, FTIR analyses (nitrate ion: $NO_3^-$) proved that a nitrogen oxide was generated on the electrode surface by using contaminants, such as fine dust, fine toner and its additives, and moisture adhering to the electrode surface, as a core. That is, the nitrogen oxide is generated on the electrode surface due to the contaminants adhering on the surface of the grid electrode, which causes the corrosion, such as rust. Since this degrades the charged potential controllability of the grid electrode, the charged potential of the surface of the photoreceptor becomes uneven.

SUMMARY OF THE INVENTION

It is an object of the invention to provide a charging device capable of easily removing contaminants adhering to a surface of an electrode so that the charged potential of a surface of a photoreceptor can be prevented from becoming uneven and the charged potential of the surface of the photoreceptor can be maintained in a proper range over a long period of time. In addition, it is another object of the invention to provide an image forming apparatus which includes the charging device and is able to record a high-quality image over a long period of time.

The invention provides a charging device comprising:

a discharge electrode to which a voltage is applied to electrically charge a surface of a photoreceptor; and a grid electrode provided between the discharge electrode and the photoreceptor in order to control a charged potential of the surface of the photoreceptor, wherein the grid electrode has a vibrating portion that vibrates itself to make the grid electrode vibrate, and wherein the vibrating portion is a piezoelectric bimorph element in which two piezoelectric elements formed of a piezoelectric material in a plate shape are bonded to each other and an electrode layer is provided between the two piezoelectric elements and which vibrates when voltages mutually reverse in phase are applied to the piezoelectric elements.

According to the invention, the vibrating portion that vibrates itself to make the grid electrode vibrate is formed in a grid electrode that controls the charged potential of the photoreceptor surface. In addition, the vibrating portion is a piezoelectric bimorph element in which two piezoelectric elements are bonded to each other and an electrode layer is provided between the two piezoelectric elements. The piezoelectric elements generate strains in the tangential direction along the surface when a voltage is applied to the piezoelectric elements. In the piezoelectric bimorph element in which the two piezoelectric elements with such characteristics are bonded to each other, when voltages mutually reverse in phase are applied to the piezoelectric elements, one of the piezoelectric elements shrinks and the other piezoelectric element extends. As a result, the free edge is curved in the entire piezoelectric bimorph element. Since the curved direction of the piezoelectric bimorph element changes when the direction of a voltage applied changes, the piezoelectric bimorph element vibrates.

Since the piezoelectric bimorph element which vibrates by the above operation is formed in the grid electrode, contaminants adhering to the surface of the grid electrode can be easily removed by the vibration. Therefore, it is possible to suppress degradation of the charged potential controllability of the grid electrode occurring due to the contaminants adhering to the surface of the grid electrode. In addition, since it can be prevented that a nitrogen oxide is generated with the contaminants adhering to the surface of the grid electrode as a core and corrosion, such as rust, occurs, it is possible to further suppress the degradation of the charged potential controllability of the grid electrode. As a result, since the charged potential controllability of the grid electrode is maintained over a long period of timer the charged potential of the photoreceptor surface can be maintained in a proper range over a long period of time.

Furthermore, in the invention, it is preferable that the vibrating portion is adapted to vibrate before application of a voltage to the discharge electrode is started or after the application of a voltage is stopped.

According to the invention, the vibrating portion is adapted to vibrate before application of a voltage to the discharge electrode is started or after the application of a voltage is stopped. Accordingly, a voltage is applied to the discharge electrode to thereby electrically charge the photoreceptor surface. While the grid electrode is controlling the charged potential, the vibrating portion does not vibrate and accordingly, the grid electrode does not vibrate. As a result, degradation of the controllability of the grid electrode with respect to the charged potential of the photoreceptor surface is suppressed.

Furthermore, in the invention, it is preferable that the vibrating portion is adapted to vibrate in both cases of before application of a voltage to the discharge electrode is started and after the application of a voltage is stopped.

According to the invention, the vibrating portion is adapted to vibrate in both cases of before application of a voltage to the discharge electrode is started and after the application of a voltage is stopped. Accordingly, it is possible to improve the capability of removing the contaminants adhering to the surface of the grid electrode while maintaining a state where degradation of the charged potential controllability of the grid electrode with respect to the photoreceptor surface is suppressed.

Furthermore, in the invention, it is preferable that the vibrating portion is formed in a tuning fork shape.

According to the invention, the vibrating portion is formed in the tuning fork shape. Therefore, when the vibrating portion vibrates, the grid electrode vibrates by resonance. As a result, a voltage value of an applied voltage required when the vibrating portion vibrates can be lowered.

Furthermore, in the invention, it is preferable that the piezoelectric elements are formed of piezoelectric ceramics.

According to the invention, the piezoelectric element is formed of piezoelectric ceramics. Accordingly, it becomes possible to make large a degree of curvature of the free end when the piezoelectric bimorph element vibrates, compared with a case where other materials, such as a polyvinylidene fluoride (PVDF), are used for the piezoelectric element. As a result, the capability of removing contaminants adhered to the surface of the grid electrode can be improved.

Furthermore, in the invention, it is preferable that a length of the piezoelectric element in a longitudinal direction thereof in the vibrating portion is set such that an entire surface of the grid electrode vibrates.

According to the invention, the length of the piezoelectric element in the longitudinal direction is set to a predetermined length. Accordingly, the entire surface of the grid electrode can be made to vibrate.

Furthermore, the invention provides an image forming apparatus comprising:

a photoreceptor having a surface on which an electrostatic latent image is formed;

the above-mentioned charging device for electrically charging the surface of the photoreceptor;

an exposure section that irradiates signal light based on image information onto the photoreceptor surface which is electrically charged to thereby form the electrostatic latent image;

a developing section that develops the electrostatic latent image on the photoreceptor surface to thereby form a toner image;

a transfer section that transfers the toner image onto a recording medium; and a fixing section that fixes the toner image transferred onto the recording medium.

According to the invention, the image forming apparatus includes a charging device capable of maintaining the charged potential of the photoreceptor surface in a proper range over a long period of time. Therefore, a high-quality image can be recorded over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1A:
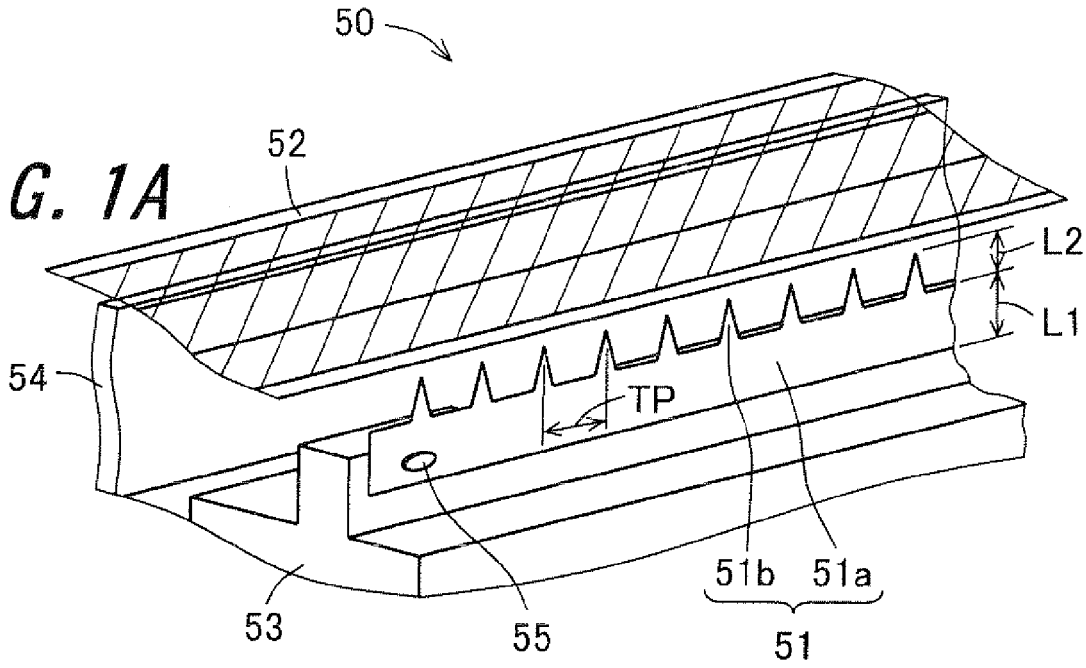
FIGS. 1A and 1B are perspective views showing the configuration of a charging device according to a first embodiment of the invention.

Now referring to the drawings, preferred embodiments of the invention are described below.

Figure 1B:
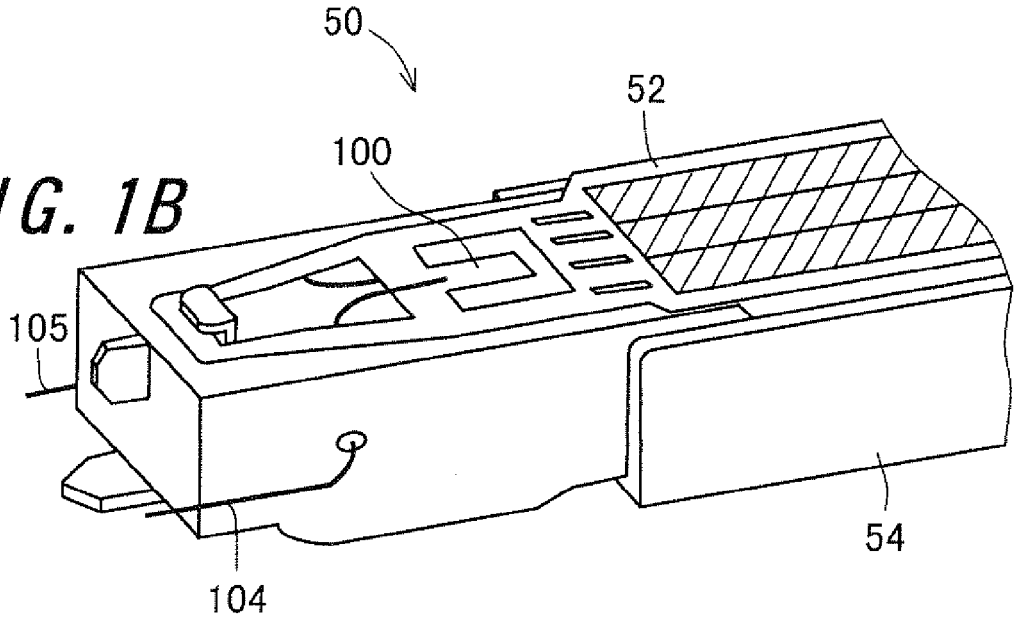

FIGS. 1A and 1B are perspective views showing the configuration of a charging device 50 according to a first embodiment of the invention. Referring to FIG. 1A, the charging device 50 includes a plate-like discharge electrode 51 (hereinafter, referred to as a 'needle-like electrode 51') having a plurality of acute protruding portions 51*b*, a holding member 53 that holds the needle-like electrode 51, a shielding case 54 that accommodates the needle-like electrode 51 and the holding member 53, and a plate-like grid electrode 52 that adjusts a charged potential of a surface of a photoreceptor. The charging device 50 is a device that makes corona discharge occur by applying a voltage to the needle-like electrode 51 which is a discharge electrode and that electrically charges a surface of a photoreceptor drum 23, which will be described later, and applies a predetermined grid voltage to the plate-like grid electrode 52 so that an electrically charged state of the surface of the photoreceptor drum 23 is made uniform and the surface of the photoreceptor drum 23 is electrically charged to predetermined electric potential and polarity. The charging device 50 is disposed to face the photoreceptor drum 23 along the axial direction of the photoreceptor drum 23 in an electrophotographic process unit 21 provided in an image forming apparatus 1 which will be described later.

While the needle-like electrode 51 is operating to make the photoreceptor drum 23, which will be described later, electrically charged, a voltage of about 5 kV is applied to the needle-like electrode 51 in order to perform corona discharge. The needle-like electrode 51 is a thin plate-like member and includes a flat plate portion 51*a* extending in one direction and an acute protruding portion 51*b* which is formed to protrude along a lateral direction of the flat plate portion 51*a* from an end surface of the flat plate portion 51*a* in the lateral direction.

Metals as a material of the needle-like electrode 51 are not particularly limited as long as the corona discharge can occur by application of a voltage and the acute protruding portion 51*b* can be formed. Example of metals include stainless steel, aluminum, nickel, copper, and iron. Among those described above, the stainless steel is preferable. Specific examples of the stainless steel include SUS304, SUS309, and SUS316. Among these examples, SUS304 is preferable.

Illustrating the dimensions of the needle-like electrode 51, a length L1 of the flat plate portion 51*a* in the lateral direction thereof is preferably about 10 mm, a length L2 of the acute protruding portion 51*b* in the protruding direction thereof is preferably about 2 mm, a radius of curvature R of the tip of the acute protruding portion 51*b* is preferably about 40 μm, and a pitch TP between the acute protruding portions 51*b* formed is preferably about 2 mm. In addition, although the thickness of the needle-like electrode 51 is not particularly limited, the thickness of the needle-like electrode 51 is set preferably to 0.05 to 1 mm, and more preferably, to 0.05 to 0.3 mm. Examples of a method of processing for the shape having such an acute protruding portion 51*b* may include an etching method and a precision press method.

The holding member 53 that holds the needle-like electrode 51 is a member which extends in one direction in the same manner as the needle-like electrode 51 and whose cross section perpendicular to a longitudinal direction has an upside-down T shape. For example, the holding member 53 is formed of a resin. The needle-like electrode 51 is screwed to one side surface of a protruding portion of the holding member 53 by a screw member 55 near both ends of the needle-like electrode 51 in the longitudinal direction thereof.

Figure 2:
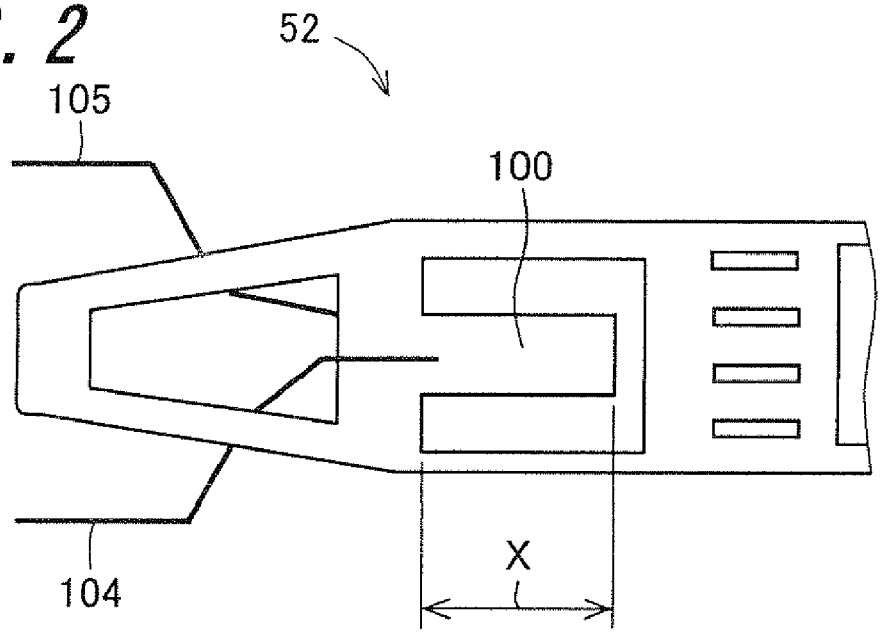
FIG. 2 is a top view showing the configuration of a plate-like grid electrode.
Figure 3:
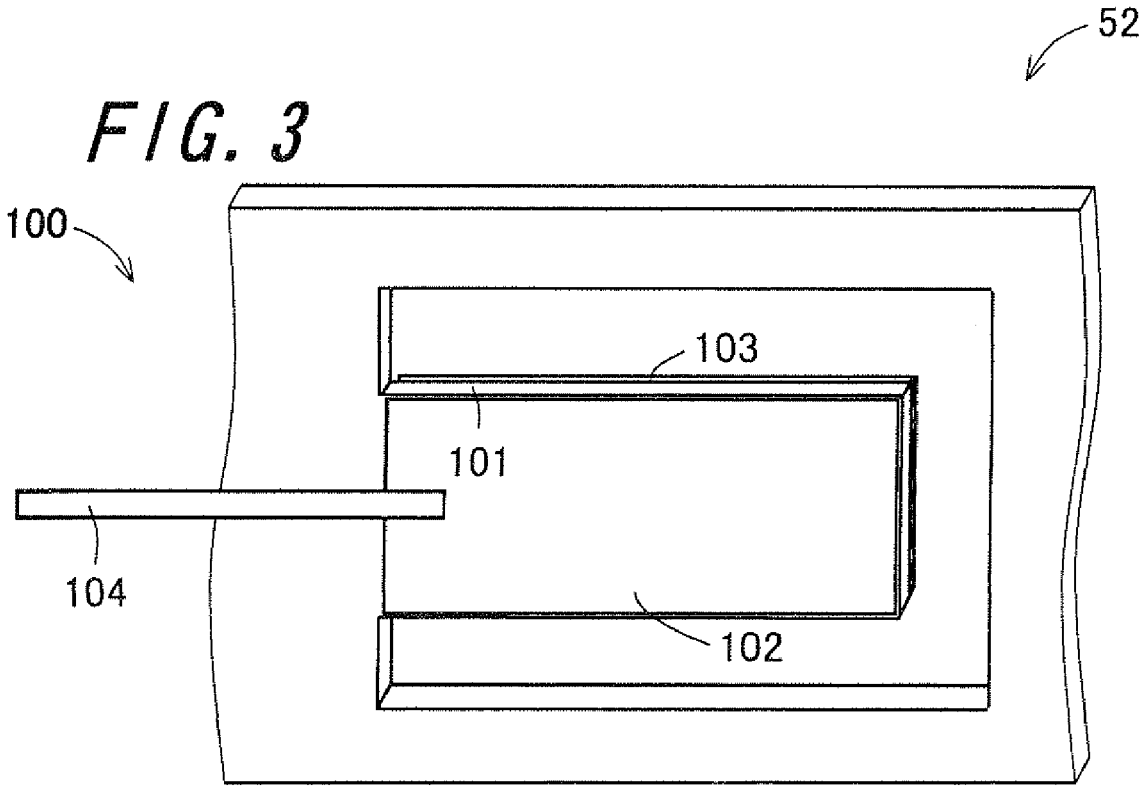
FIG. 3 is a partially enlarged view showing the plate-like grid electrode.

FIG. 2 is a top view showing the configuration of the plate-like grid electrode 52. In addition, FIG. 3 is a partially enlarged view showing the plate-like grid electrode 52. FIG. 1B is also referenced. The plate-like grid electrode 52 is provided between the needle-like electrode 51 and the photoreceptor drum 23 to be described later. When a voltage is applied to the plate-like grid electrode 52, the plate-like grid electrode 52 adjusts a variation in an electrically charged state of a surface of the photoreceptor drum 23 so that the charged potential is made uniform. The plate-like grid electrode 52 is formed of the same metal material as the needle-like electrode 51 and is formed in the plate shape. In addition, the plate-like grid electrode 52 is formed by performing masking processing and etching processing such that the perforated shape having a plurality of through holes is formed by chemical polishing processing. The plate-like grid electrode 52 formed as described above is stretched between the needle-like electrode 51 and the photoreceptor drum 23 with a tensile force of about 1 kgf (about 9.8 N) applied.

Illustrating the dimensions of the plate-like grid electrode 52 formed in the plate shape, the length in the longitudinal direction thereof is preferably about 370 mm and the length in the lateral direction thereof is preferably about 14 mm. In addition, although the thickness of the plate-like grid electrode 52 is not particularly limited, the thickness of the plate-like grid electrode 52 is set to preferably 0.05 to 0.2, and more preferably, to 0.1 mm.

As described above, since the plate-like grid electrode 52 is formed of a metallic material, such as stainless steel, contaminants adhering to the electrode surface serve as a core to generate a nitrogen oxide. As a result, corrosion, such as rust, may occur. Since this degrades the charged potential controllability of the plate-like grid electrode 52, the charged potential of the surface of the photoreceptor drum 23 becomes uneven.

Accordingly, a piezoelectric bimorph element 100 which is a vibrating portion is formed in the plate-like grid electrode 52 in the invention. The piezoelectric bimorph element 100 is a member which vibrates so that the plate-like grid electrode 52 can be vibrated. The piezoelectric bimorph element 100 can easily remove contaminants adhering to the surface of the plate-like grid electrode 52 by vibration.

The piezoelectric bimorph element 100 has a first piezoelectric element 102 and a second piezoelectric element 103 bonded to each other and a base portion 101, which is an electrode layer, provided between the first piezoelectric element 102 and the second piezoelectric element 103. In addition, as electric wiring lines used when a voltage is applied to the piezoelectric bimorph element 100, a first harness line 104 is connected to the first piezoelectric element 102 and a second harness line 105 is connected to the second piezoelectric element 103.

The base portion 101 is a portion to which a voltage for vibrating the piezoelectric bimorph element 100 is applied and is formed of a metallic material. In the present embodiment, the base portion 101 is a remaining portion obtained after cutting, in a 'U' shape, a flat plate portion at an end of the plate-like grid electrode 52 in the longitudinal direction thereof in which a through hole is not formed. The base portion 101 is formed in the rectangular shape, and one end of the base portion 101 is connected to the flat plate portion and the other end of the base portion 101 is a free end. In addition, although a direction of the base portion 101 extending in the longitudinal direction is not particularly limited, the direction is assumed to be the same as the longitudinal direction of the plate-like grid electrode 52 in the present embodiment. This makes the vibration of the piezoelectric bimorph element 100 efficiently traveling to the entire surface of the plate-like grid electrode 52, such that the plate-like grid electrode 52 can vibrate efficiently.

The two piezoelectric elements 102 and 103 are formed of a piezoelectric material which generates a strain in the tangential direction along the surface when a voltage is applied. Examples of the piezoelectric material may include: ceramics-based piezoelectric materials, such as a barium titanate ($BaTiO_3$), a lead titanate ($PbTiO_3$), a titanic acid lead zirconate ($Pb(Zr.TiO_3)$), and a niobic acid lead ($PbNb_2O_6$); polymer piezoelectric materials, such as a polyvinylidene fluoride (PVDF); and single crystal piezoelectric materials, such as a lithium niobate ($LiNbO_3$) and crystal. Also those piezoelectric materials, it is preferable to use the ceramics-based piezoelectric materials. Thus, it becomes possible to make large the amount of strain of the free end when the piezoelectric bimorph element 100 to be described later vibrates, compared with a case where other materials are used as the piezoelectric materials. As a result, the capability of removing contaminants adhering to the plate-like grid electrode 52 can be improved. In addition, since the ceramics-based piezoelectric, material is widely used as a piezoelectric element, such as a buzzer, the ceramics-based piezoelectric material is versatile and is available at a low cost.

In addition, the two piezoelectric elements 102 and 103 are formed to cover a surface of the base portion 101. The first piezoelectric element 102 is formed on one surface of the base portion 101 in a thickness direction thereof, and the second piezoelectric element 103 is formed on the other surface of the base portion 101 in the thickness direction. At this time, the shapes of the piezoelectric elements 102 and 103 are formed in the rectangular plate shapes corresponding to the shape of the base portion 101. For example, the piezoelectric elements 102 and 103 can be formed by coating the above-described piezoelectric material on the surface of the base portion 101 and then performing baking treatment. Thus, the piezoelectric bimorph element 100 in which one end is connected to the flat plate portion of the plate-like grid electrode 52 and the other end is a free end is formed.

Although the piezoelectric bimorph element 100 may be formed in the plate-like grid electrode 52 in plural numbers and the number of piezoelectric bimorph elements 100 is not particularly limited, the positions at which the piezoelectric bimorph elements 100 are formed are limited to the flat plate portion at the end of the plate-like grid electrode 52 in the longitudinal direction thereof in which a through hole is not formed. If the number of piezoelectric bimorph elements 100 formed in the plate-like grid electrode 52 is increased, the capability of vibrating the plate-like grid electrode 52 may be improved and the contaminants may be efficiently removed. In this case, however, since it becomes complicated to control the plurality of piezoelectric bimorph elements 100, the manufacturing cost of the plate-like grid electrode 52 is increased. Therefore, in the present embodiment, one piezoelectric bimorph element 100 is formed in the plate-like grid electrode 52.

Figure 4A:
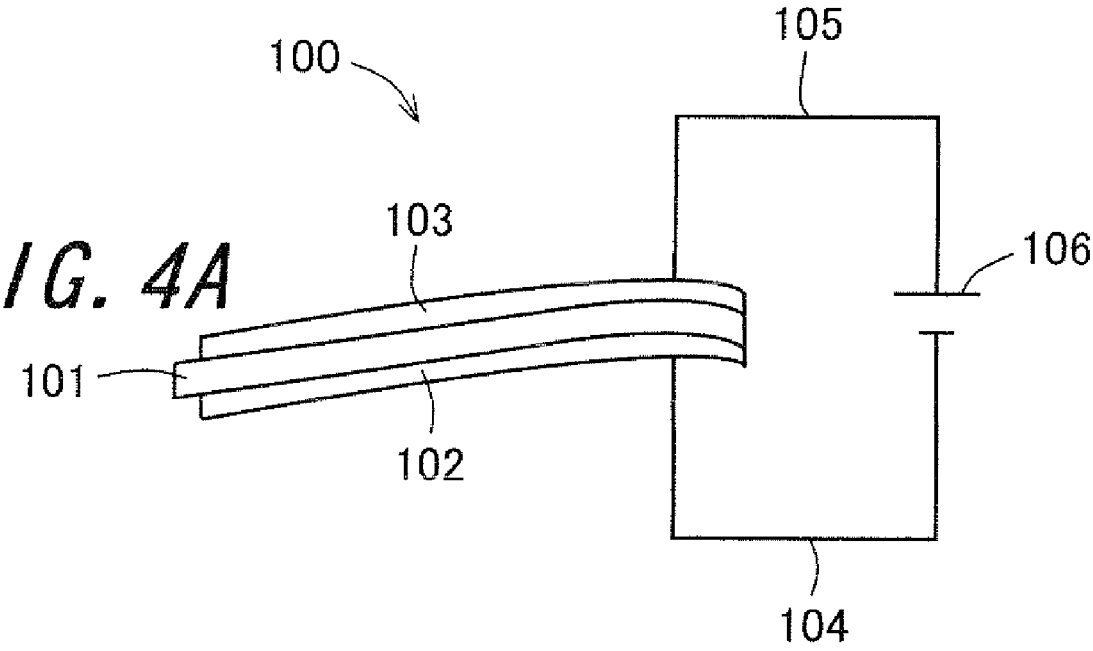
FIGS. 4A and 4B are views for explaining an operation of a piezoelectric bimorph element.
Figure 4B:
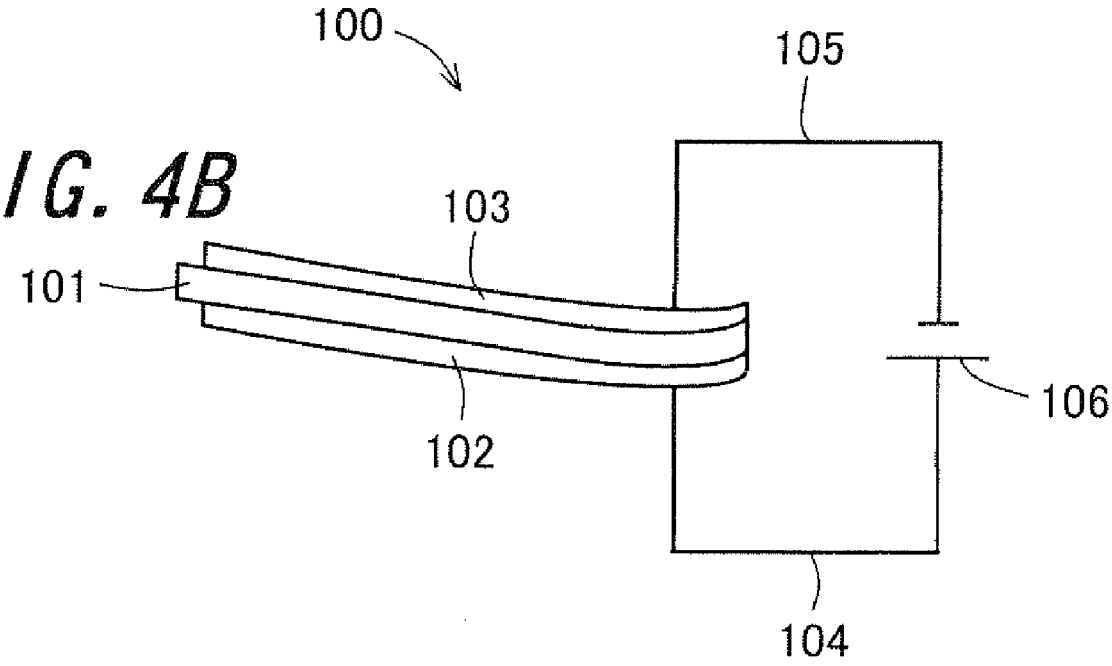

FIGS. 4A and 4B are views for explaining an operation of the piezoelectric bimorph element 100. The two piezoelectric elements 102 and 103 of the piezoelectric bimorph element 100 are polarized in the thickness direction, and the direction of the polarization is equal in the two piezoelectric elements 102 and 103. When an alternating voltage is applied from a driving power source 106 to the base portion 101 through the harness lines 104 and 105, the two piezoelectric elements 102 and 103 generate strains in the tangential direction (direction parallel to the longitudinal direction of the plate-like grid electrode 52) along the surface. In the piezoelectric bimorph element 100 in which the two piezoelectric elements with such characteristics are bonded to each other, when voltages mutually reverse in phase are applied to the piezoelectric elements 102 and 103, one of the piezoelectric elements shrinks and the other piezoelectric element extends. As a result, in the entire piezoelectric bimorph element 100, the free end is curved in the entire piezoelectric bimorph element 100.

For example, in FIG. 4A, the second piezoelectric element 103 to which a positive voltage is applied extends in the tangential direction along the surface and the first piezoelectric element 102 to which a negative voltage is applied shrinks in the tangential direction along the surface. As a result, the entire piezoelectric bimorph element 100 is curved in a direction in which the first piezoelectric element 102 is disposed. Then, when the polarities of the voltages applied to the two piezoelectric elements 102 and 103 are reversed by using a switching circuit or the like, as shown in FIG. 4B, the second piezoelectric element 103 to which a negative voltage is applied shrinks in the tangential direction along the surface and the first piezoelectric element 102 to which a positive voltage is applied extends in the tangential direction along the surface. As a result, the entire piezoelectric bimorph element 100 is curved in a direction in which the second piezoelectric element 103 is disposed. Thus, since the curved direction of the free end of the piezoelectric bimorph element 100 changes when the directions of the voltages applied to the piezoelectric elements 102 and 103 change, the piezoelectric bimorph element 100 vibrates.

When the piezoelectric bimorph element 100 vibrates in such a manner, the vibration travels to the surface of the plate-like grid electrode 52, which can make the plate-like grid electrode 52 vibrate. Accordingly, the contaminants adhering to the surface of the plate-like grid electrode 52 can be easily removed by the vibration. Therefore, it is possible to suppress degradation of the charged potential controllability of the plate-like grid electrode 52 occurring due to the contaminants adhering to the surface of the plate-like grid electrode 52. In addition, since it can be prevented that a nitrogen oxide is generated with the contaminants adhering to the surface of the plate-like grid electrode 52 as a core and corrosion, such as rust, occurs, it is possible to further suppress the degradation of the charged potential controllability of the plate-like grid electrode 52. Therefore, since the charged potential controllability of the plate-like grid electrode 52 is maintained over a long period of time, the charged potential of the photoreceptor drum 23 can be maintained in a proper range over a long period of time.

In addition, in a typical charging device, a cleaning member which cleans the surface of the plate-like grid electrode by scraping may be provided to remove the contaminants adhering to the surface of the plate-like grid electrode. In the charging device 50 of the invention, since the piezoelectric bimorph element 100 is formed on the surface of the plate-like grid electrode 52 so that the contaminants can be removed a by vibration of the piezoelectric bimorph element 100, the device can be simplified without a need to use the cleaning member.

The capability of vibrating the plate-like grid electrode 52 and the capability of removing the contaminants adhering to the surface of the plate-like grid electrode 52 are decided by the amount of strain of the free end of the piezoelectric bimorph element 100. That is, the amplitude of vibration of the plate-like grid electrode 52 increases as the amount of strain of the free end of the piezoelectric bimorph element 100 increases and accordingly, the capability of removing the contaminants by vibration is improved.

The amount of strain ΔL of the free end of the piezoelectric bimorph element 100 is expressed in the following expression (1).

$$\Delta L = \frac{3}{4} \cdot \left(\frac{L}{t}\right)^2 \cdot d_{31} \cdot v \tag{1}$$

In the expression, 'L' indicates the length of a piezoelectric element, 't' indicates the thickness of the piezoelectric element, 'V' indicates an applied voltage, and '$d_{31}$' indicates a piezoelectric strain constant.

As is apparent from the expression (1), the amount of strain ΔL of the free end of the piezoelectric bimorph element 100 can be made large by setting large the lengths of the piezoelectric elements 102 and 103 in the longitudinal direction thereof, that is, the length of the piezoelectric bimorph element 100 in the longitudinal direction. Accordingly, the capability of removing the contaminants can be improved by making the length of the piezoelectric bimorph element 100 as large as possible. However, when the length of the piezoelectric bimorph element 100 becomes so long that the amount of strain ΔL of the free end becomes too large, a middle portion of the plate-like grid electrode 52 disposed to be stretched vibrates largely. As a result, the plate-like grid electrode 52 may come in contact with the photoreceptor drum 23. For this reason, in the present embodiment, the length of the piezoelectric bimorph element 100 is set to a level allowing the entire top surface of the plate-like grid electrode 52 to vibrate. Here, it is preferable that the length of the piezoelectric Dimorph element 100 be set to 3.7 to 7.4 mm such that the length of the piezoelectric bimorph element 100 is about 1 to 2% of the length of the plate-like grid electrode 52 in the longitudinal direction.

In addition, in the case where the thicknesses of the piezoelectric elements 102 and 103 is set to be equal to or larger than the thickness of the base portion 101, the amount of strain ΔL of the free end of the piezoelectric bimorph element 100 can be made large by setting the thicknesses of the piezoelectric elements 102 and 103 small, as is apparent from the expression (1). In the present embodiment, the rate of the thicknesses of each of the piezoelectric elements 102 and 103 to the thickness of the base portion 101 is set to five to eight times. Specifically, while the thickness of the base portion 101 is 0.1 mm, the thicknesses of the piezoelectric elements 102 and 103 are set to be in a range of 0.5 to 0.8 mm. When the thickness of each of the piezoelectric elements 102 and 103 is larger than 0.8 mm, the amount of strain of the piezoelectric bimorph element 100 becomes too small. In addition, when the thickness of each of the piezoelectric elements 102 and 103 is smaller than 0.5 mm, an influence of the base portion 101 becomes large. As a result, it becomes difficult to make the free end of the piezoelectric bimorph element 100 curved.

If a voltage applied to the piezoelectric bimorph element 100 is set to be about DC 70 V, the amount of strain ΔL of the free end of the piezoelectric bimorph element 100 can be sufficiently obtained. In addition, in order to change the curved direction of the free end of the piezoelectric bimorph element 100, the voltage applied to the piezoelectric bimorph element 100 is configured such that the polarity of the voltage applied to the two piezoelectric elements 102 and 103 changes using a switching circuit or the like. In this case, it may be possible to change the polarity of the voltage applied to the two piezoelectric elements 102 and 103 by using an AC voltage power source.

In addition, it is preferable that a frequency of applying a voltage to the piezoelectric bimorph element 100 be set to be within a range of 100 to 1600 Hz. Since the frequency in this range is close to a natural frequency of the plate-like grid electrode 52 formed of stainless steel, the plate-like grid electrode 52 can be made to vibrate suitably.

In addition, the voltage applied to the piezoelectric bimorph element 100 may also be supplied from a voltage power source which applies a voltage to the needle-like electrode 51 in electrically charging the surface of the photoreceptor drum 23.

In addition, the piezoelectric bimorph element 100 may be adapted to be able to make the plate-like grid electrode 52 vibrate and the shape, the arrangement position, and the like are not limited to those described above.

The shielding case 54 is formed of stainless steel, for example. The shielding case 54 is a container shaped member whose outer shape is a rectangular parallelepiped and which has an internal space and has an opening on one surface facing the photoreceptor drum 23 to be described later. In addition, the shielding case 54 extends long in the same direction as the needle-like electrode 51, and the cross-sectional shape of the shielding case 54 in a direction perpendicular to the longitudinal direction has an approximately 'U' shape. The holding member 53 is mounted on a bottom surface of the shielding case 54.

Figure 5:
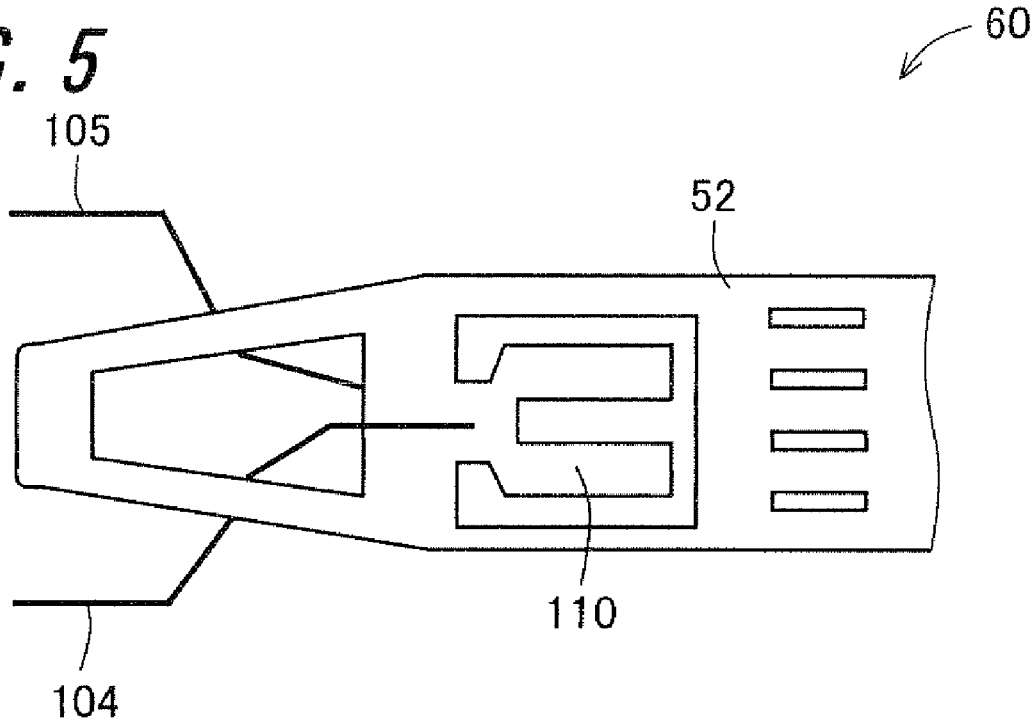
FIG. 5 is a top view showing the configuration of a charging device according to a second embodiment of the invention.

FIG. 5 is a top view showing the configuration of a charging device 60 according to a second embodiment of the invention. The charging device 60 is similar to the charging device 50 according to the first embodiment. Accordingly, corresponding components are denoted by the same reference numerals, and an explanation thereof will be omitted. The charging device 60 is the same as the above-described charging device 50 except that the shape of a piezoelectric bimorph element 110 for vibrating the plate-like grid electrode 52 is different from the shape of the piezoelectric bimorph element 100.

The piezoelectric bimorph element 110 formed in the plate-like grid electrode 52 of the charging device 60 is formed in the plate shape, and a surface of the piezoelectric bimorph element 110 has a tuning fork shape. For this reason, when the piezoelectric bimorph element 110 vibrates, the plate-like grid electrode 52 vibrates by resonance. As a result, a voltage value of an applied voltage required when the piezoelectric bimorph element 110 vibrates can be lowered.

Figure 6:
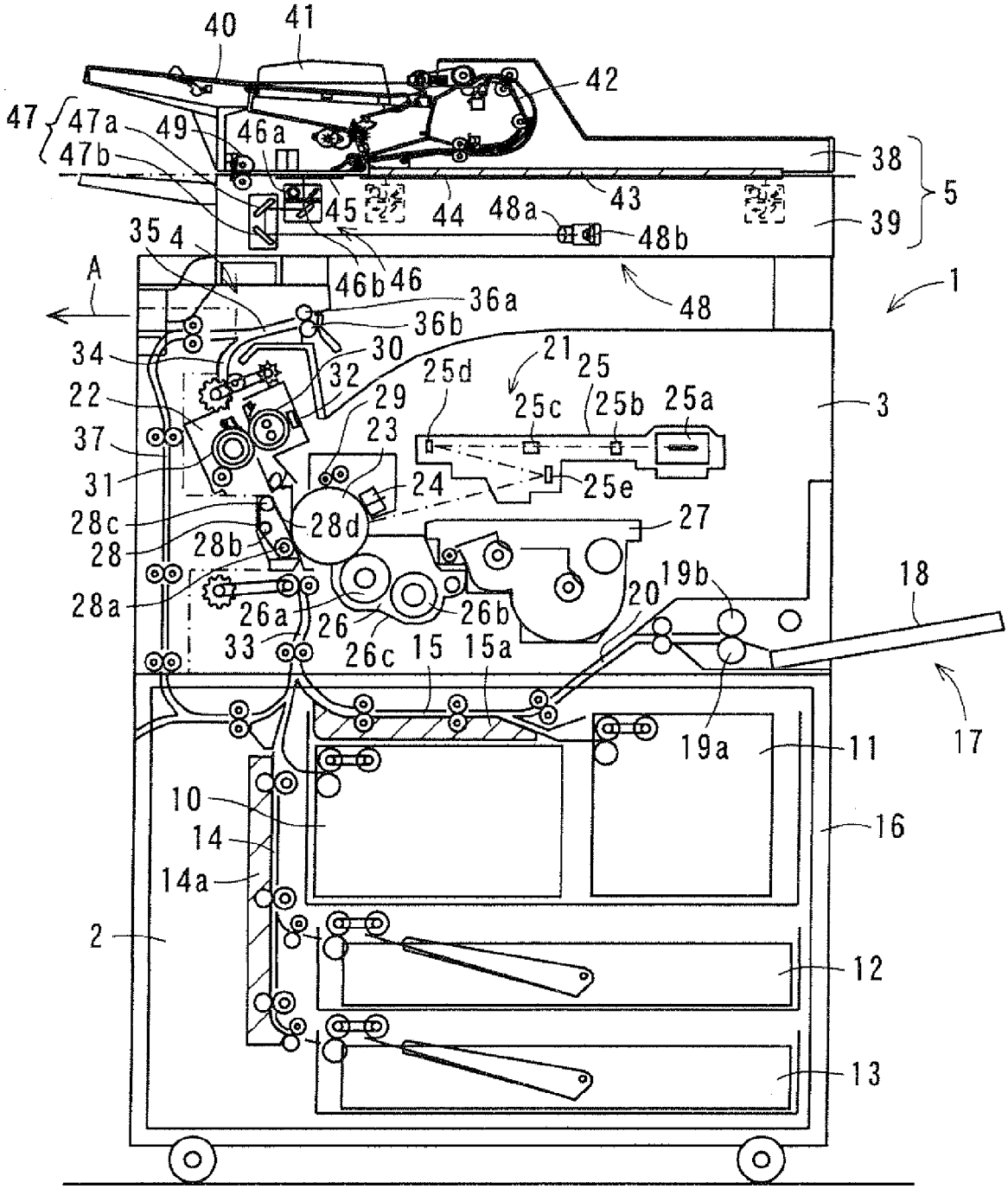
FIG. 6 is a view showing the configuration of an image forming apparatus according to an embodiment of the invention.

FIG. 6 is a view showing the configuration of an image forming apparatus 1 according to an embodiment of the invention. The image forming apparatus 1 includes the charging device 50 or 60 capable of maintaining the charged potential of the surface of the above-described photoreceptor in a proper range over a long period of time. Therefore, a high-quality image can be recorded over a long period of time. The image forming apparatus 1 is a multifunctional peripheral having a copy function, a printer function, and a facsimile function. That is, the image forming apparatus 1 has three kinds of print modes of a copier mode (copy mode), a printer mode, and a FAX mode. For example, in response to operation input from an operation section (not shown) or reception of a print job from an external host apparatus, such as a personal computer, the print mode is selected by a control section (not shown).

The image forming apparatus 1 includes: a paper feed unit 2 that stores recording mediums and feeds the recording medium to an image forming section 3 to be described later; the image forming section 3 that forms an image on the recording medium; a discharge section 4; and a document reading section 5 that reads an image and/or a character written in a document to be copied, converts the information into an electrical signal, and transmits the signal to the image forming section 3.

The paper feed unit 2 includes: paper feed trays 10, 11, 12, and 13 that accommodate recording mediums, such as recording paper and OHP films; first and second conveyance paths 14 and 15 for transporting the recording medium accommodated in the paper feed trays 10 to 13 to the image forming section 3; a frame 16 that accommodates and protects the paper feed trays 10 to 13 and the first and second conveyance paths 14 and 15; and a manual feed section 17 provided above the frame 16.

The paper feed trays 10 to 13 can accommodate recording mediums with different types and sizes for each tray, for example. Here, the sizes refer to, for example, A3, A4, B4, and B5 sizes set in JIS P 0138 or JIS P 0202. In addition, recording mediums not specified may also be accommodated without being limited to such sizes. On the other hand, the types mean recording paper, such as plain paper and paper for color copy, an OHP film, and the like. It is needless to say that recording mediums with the same size and type may also be accommodated in the paper feed trays 10 to 13. The paper feed trays 10 and 11 are disposed in parallel, and the paper feed tray 12 is disposed below the paper feed trays 10 and 11 and the paper feed tray 13 is disposed below the paper feed tray 12. Replenishment of the paper feed trays 10 to 13 with recording mediums is performed by pulling out the paper feed trays 10 to 13 toward a front side (operation side) of the image forming apparatus 1, for example.

The first conveyance path 14 is provided to extend in an approximately vertical direction, which is a vertical direction with respect to a plane on which the image forming apparatus 1 is provided, along the frame 16 of the paper feed unit 2 and feeds recording mediums accommodated in the paper feed trays 10, 12, and 13 to the image forming section 3. In addition, the second conveyance path 15 is provided to extend in an approximately horizontal direction, which is a parallel direction with respect to the plane on which the image forming apparatus 1 is provided, along the frame 16 of the paper feed unit 2 and feeds a recording medium accommodated in the paper feed tray 11 to the image forming section 3. Thus, in the frame 16 of the paper feed unit 2, the paper feed trays 10 to 13 and the first and second conveyance paths 14 and 15 are disposed efficiently. Accordingly, the space can be saved.

The manual feed section 17 is provided above the frame 16 and includes: a manual feed tray 10; paper feed rollers 19*a* and 19*b* that make a recording medium supplied to the manual feed tray 18 inserted to the inside of the image forming apparatus 1; and a manual conveyance path 20 which is provided to be connected to the second conveyance path 15 and serves to supply to the image forming section 3 the recording medium inserted to the inside of the image forming apparatus 1 by the paper feed rollers 19*a* and 19*b*.

The manual feed tray 18 is fixed to an upper side of the frame 16 in the image forming apparatus 1 and is provided such that a part of the manual feed tray 18 protrudes outward from a side surface of the image forming apparatus 1. In addition, the manual feed tray 18 is provided to be able to be received in the image forming apparatus 1. In addition, a recording medium is supplied from the manual feed tray 18 to the inside of the image forming apparatus 1.

The paper feed rollers 19*a* and 19*b* are in pressure-contact with each other and are provided to be rotatably driven around axes thereof by a driving section (not shown). A recording medium supplied from the manual feed tray 18 to a pressure-contact portion of the paper feed rollers 19*a* and 19*b* is fed to the manual conveyance path 20 by rotation driving of the paper feed rollers 19*a* and 19*b*.

The manual conveyance path 20 is provided to pass through the frame 16 and be connected to the second conveyance path 15. The recording medium fed to the manual conveyance path 20 by the paper feed rollers 19*a* and 19*b* passes through the second conveyance path 15 and is supplied to the image forming section 3.

According to the manual feed section 17, the recording medium supplied from the manual feed tray 18 is fed to the manual conveyance path 20 by the paper feed rollers 19*a* and 19*b* and is further fed to the image forming section 3 through the second conveyance path 15.

In the paper feed unit 2, in case of forming an image on a recording medium, a tray on which recording mediums with the size and type designated beforehand are accommodated is selected from the paper feed trays 10 to 13, the recording mediums are separated from the tray one by one, and the recording medium separated is fed to the image forming section 3 through either the first conveyance path 14 or the second conveyance path 15 such that the image is formed. Alternatively, a recording medium supplied from the manual feed section 17 is similarly fed to the image forming section 3 such that the image is formed.

The image forming section 3 includes an electrophotographic process unit 21 that transfers a toner image, which is formed corresponding to image data, on a recording medium and a fixing portion 22 that fixes the toner image, which is transferred onto the recording medium in the electrophotographic process unit 21, to the recording medium.

The electrophotographic process portion 21 includes a photoreceptor drum 23, a charging section 24, a light scanning unit 25, a developing unit 26, a developer containing unit 27, a transfer unit 28, and a cleaning unit 29.

The photoreceptor drum 23 is supported to be rotatably driven around an axis thereof by a driving section (not shown) and includes a conductive substrate (not shown) and a photosensitive layer formed on a surface of the conductive substrate. The conductive substrate has a cylindrical, columnar, or thin film shape, preferably, the cylindrical shape.

As for a conductive material which is a material of the conductive substrate, materials commonly used in this field may be used, and examples thereof include: metals such as aluminum, copper, brass, zinc, nickel, stainless steel, chromium, molybdenum, vanadium, indium, titanium, gold, and platinum; alloys containing two or more of the metals; conductive films obtained by forming a conductive layer, which includes one or two or more of aluminum, aluminum alloy, tin oxide, gold, and indium oxide, on a film-like base such as a synthetic resin film, a metallic film, and paper; and resin compositions controlling conductive particles and/or conductive polymers. In addition, as for the film-like base used for a conductive film, the synthetic resin film is preferable and a polyester film is particularly preferable. In addition, as for a method of forming a conductive layer in the conductive film, vapor deposition, coating, and the like are preferable.

The photosensitive layer is formed by laminating a charge generating layer containing a charge generating substance and a charge transporting layer containing a charge transporting substance, for example. In this case, it is preferable to provide an undercoat layer between the conductive substrate and the charge generating layer or the charge transporting layer. By providing the undercoat layer, a damaged spot and unevenness existing on a surface of the conductive substrate are covered. As a result, advantages that the surface of the photosensitive layer is made smooth, degradation of the charging ability of the photosensitive layer when repeatedly used is prevented, and the charging ability of the photosensitive layer under low temperature and/or low humidity environment is improved are obtained.

The charge generating layer contains a charge generating substance, which generates an electric charge by irradiation of light, as a main ingredient and contains known binder resin, plasticizer, sensitizer, and the like as needed. As for the charge generating substance, substances commonly used in this field may be used, and examples thereof include: perylene-based pigments such as peryleneimide and perylenic anhydride; polycyclic quinone-based pigments such as quinacridone and anthraquinone; phthalocyanine-based pigments such as metallic or non-metallic phthalocyanines and halogenated non-metallic phthalocyanines; squarylium coloring matters; azulenium coloring matters; thiapyrylium coloring matters; and aza pigments having a carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton or distyrylcarbazole skeleton. Among those described above, non-metallic phthalocyanine pigments, oxotitanyl phthalocyanine pigments, biz-azo pigments having a fluorene ring and/or a fluorenone ring, biz-azo pigments and tris-azo pigments made of aromatic amines have a high charge generating property and are suitable for obtaining highly sensitive photoconductive layers. These charge generating substances may be used each alone, or two or more of them may be used in combination. Although the contents of the charge generating substances are not particularly limited, the charge generating substance is used preferably in 5 to 500 parts by weight, more preferably in 10 to 200 parts by weight, based on 100 parts by weight of the binding resin in the charge generating substance.

As for the binder resin for a charge generating layer, materials commonly used in this field may be used, and examples thereof include melamine resins, epoxy resins, silicon resins, polyurethane, acrylic resins, vinyl chloride-vinyl acetate copolymers, polycarbonate, phenoxy resins, polyvinyl butyral resins, polyarylate, polyamide, polyester, and the like. These binder resins may be used each alone, or two or more of them may be used in combination as needed.

The charge generating layer can be formed by preparing liquid for application of a charge generating layer by dissolving or dispersing a suitable amount of charge generating substance and binder resin, including plasticizer and sensitizer as needed, in a suitable organic solvent in which the components can be dissolved or dispersed, coating the liquid for application of a charge generating layer on a surface of the conductive substrate, and drying the liquid. Although the thickness of the charge generating layer obtained as described above is not particularly limited, the thickness of the charge generating layer is set preferably to 0.05 to 5 μm, and more preferably, to 0.1 to 2.5 μm.

The charge transporting layer laminated on the charge generating layer contains, as an essential ingredient, a charge transporting substance having an ability to receive and transport an electric charge generated from the charge generating substance and a binder resin for a charge transporting layer and contains known antioxidant, plasticizer, sensitizer, lubricant, and the like as needed. As for the charge transporting substance, substances commonly used in this field may be used, and examples thereof include: electron donor substances such as poly-N-vinyl carbazole and its derivatives, poly-γ-carbazolylethylglutamate and its derivatives, pyrene-formaldehyde condensates and its derivatives, polyvinyl pyrene, polyvinyl phenanthrene, oxazole derivatives, oxodiazole derivatives, imidazole derivatives, 9-(p-diethylamino styryl)anthracene, 1,1-bis(4-dibenzylaminophenyl)propane, styryl anthracene, styryl pyrazoline, pyrazoline derivatives, phenylhydrazones, hydrazone derivatives, triphenylamine compounds, tetraphenyldiamine compounds, triphenylmethane compounds, stilbene compounds, and azine compounds having a 3-methyl-2-benzothiazoline ring; and electron acceptor substances such as fluorenone derivatives, dibenzothiophene derivatives, indenothiophene derivatives, phenanethrenequinone derivatives, indenopyridine derivatives, thioxanthone derivatives, benzo[c] cinnoline derivatives, phenazine oxide derivatives, tetracyanoethylene, tetracyanoquinodimethane, bromanil, chloranil, and benzoquinone. These charge transporting substances may be used each alone, or two or more of them may be used in combination. Although the contents of the charge transporting substances are not particularly limited, the charge transporting substance is used preferably in 10 to 300 parts by weight, more preferably in 30 to 150 parts by weight, based on 100 parts by weight of the binding resin in the charge transporting layer.

As for the binding resins for the charge transporting layer, materials which are commonly used in this field and can disperse the charge transporting substance uniformly may be used, and examples thereof include polycarbonate, polyarylate, polyvinyl butyral, polyamide, polyester, polyketone, epoxy resins, polyurethane, polyvinylketone, polystyrene, polyacrylamide, phenol resins, phenoxy resins, polysulfone resins, and copolymers thereof. Among those described above, polycarbonate (hereinafter, referred to as 'bisphenol Z type polycarbonate') containing bisphenol Z as a monomer component and a mixture of the bisphenol Z type polycarbonate and other polycarbonate are preferably used when the film formation efficiency, the abrasion resistance and electrical property of a charge transporting layer obtained, and the like are taken into consideration. These binder resins may be used each alone, or two or more of them may be used in combination.

In the charge transporting layer, it is preferable that an antioxidant be contained together with the charge transporting substance and the binder resin for a charge transporting substance. As for the antioxidant, materials commonly used in this field may be used, and examples thereof include vitamin E, hydroquinone, hindered amine, hindered phenol, paraphenylenediamine, arylalkanes, and derivatives thereof, organic sulfur compounds, and organic phosphorus compounds. These antioxidants may be used each alone, or two or more of them may be used in combination. Although the contents of the antioxidants are not particularly limited, the antioxidant is used preferably in 0.01 to 10% by weight of the total amount of components that form a charge transporting layer, more preferably in 0.05 to 5% by weight.

The charge transporting layer can be formed by preparing liquid for application of a charge transporting layer by dissolving or dispersing a suitable amount of charge transporting substance and binder resin, including antioxidant, plasticizer, and sensitizer as needed, in a suitable organic solvent in which the components can be dissolved or dispersed, coating the liquid for application of a charge transporting layer on a surface of the charge generating layer, and drying the liquid. Although the thickness of the charge transporting layer obtained as described above is not particularly limited, the thickness of the charge transporting layer is set preferably to 10 to 50 μm, and more preferably, to 15 to 40 μm.

In addition, a photosensitive layer in which a charge generating substance and a charge transporting substance are present in one layer may also be formed. In this case, types and contents of charge generating substance and charge transporting substance, types of binder resins, additives, and the like may be the same as a case where a charge generating layer and a charge transporting layer are formed separately.

In the present embodiment similar to the above-described, a photoreceptor obtained by forming an organic photosensitive layer using the charge generating substance and the charge transporting substance is used. Instead of the photoreceptor, however, a photoreceptor obtained by forming an inorganic photosensitive layer using silicon or the like may also be used.

The charging section 24 faces the photoreceptor drum 23, is disposed to be spaced apart from the surface of the photoreceptor drum 23 along the longitudinal direction of the photoreceptor drum 23, and electrically charges the surface of the photoreceptor drum 23. The charging section 24 is the charging device 50 or 60 described above. Thus, the image forming apparatus 1 includes the charging device 50 or 60 capable of maintaining the charged potential of the surface of the photoreceptor drum 23 in a proper range over a long period of time. Therefore, a high-quality image can be recorded over a long period of time.

The light scanning unit 25 is formed by using a semiconductor laser, for example. The light scanning unit 25 includes: a laser light source 25*a* that emits a laser beam modulated according to image document information inputted from the document reading section 5 or an external device; a polygon mirror 25*b* that makes a laser beam emitted from the laser light source 25*a* deflect in the main scanning direction; a lens 25*c* that converges the laser beam deflected in the main scanning direction by the polygon mirror 25*b* such that the laser beam is imaged on the surface of the photoreceptor drum 23; and mirrors 25*d* and 25*e* that reflect the laser beam converging by the lens 25*c*. The laser beam emitted from the laser light source 25*a* is deflected by the polygon mirror 25*b*, converged by the lens 25*c*, reflected by the mirrors 25*d* and 25*e*, and irradiated onto the surface of the photoreceptor drum 23 charged in predetermined electric potential and polarity, such that an electrostatic latent image corresponding to image document information is formed.

The developing unit 26 includes: a developing roller 26*a* that is provided to face and be in pressure-contact with the photoreceptor drum 23 and that supplies a developer containing toner to the electrostatic latent image formed on the surface of the photoreceptor drum 23; a supply roller 26*b* that is provided to be in pressure-contact with the developing roller 26*a* and that supplies a developer containing toner to the developing roller 26*a*; and a casing 26*c* that supports the developing roller 26*a* and the supply roller 26*b* so that the developing roller 26*a* and the supply roller 26*b* can freely rotate and contains a developer in an internal space thereof. The developer contained in the casing 26*c* adheres to a surface of the developing roller 26*a* by rotation driving of the supply roller 26*b* and is then supplied from the surface of the developing roller 26*a* to the electrostatic latent image on the surface of the photoreceptor drum 23, such that the electrostatic latent image is developed and a toner image is obtained.

The developer containing unit 27 is a developer container provided adjacent to the developing unit 26, and supplies a suitable amount of developer to the developing unit 26 according to the amount of developer remaining in the developing unit 26.

The transfer unit 28 includes: a driving roller 28*a* provided to be rotatably driven around an axis thereof by a driving section (not shown); driven rollers 28*b* and 28*c*; and an endless belt 28*d* stretched over the driving roller 28*a* and the driven rollers 28*b* and 28*c*. The driving roller 28*a* is provided not only to be rotatably driven but also to face the photoreceptor drum 23 with the endless belt 28*d* interposed therebetween so that the photoreceptor drum 23, the endless belt 28*d*, and the driving roller 28*a* are in pressure-contact with each other in this order. According to the transfer unit 28, a recording medium from the paper feed unit 2 passes through a third conveyance path 33 to be supplied between the photoreceptor drum 23 and the endless belt 28*d*. Then, the recording medium comes in pressure-contact with the surface of the photoreceptor drum 23 of the driving roller 28*a*, and a toner image on the surface is transferred onto the recording medium. After the toner image 28 transferred, the recording medium is fed to the fixing portion 22.

The cleaning unit 29 cleans the surface of the photoreceptor drum 23 by removing the toner remaining on the surface of the photoreceptor drum 23 after the transfer unit 28 has transferred the toner image onto the recording medium. For example, a cleaning blade is used for the cleaning unit 29. In addition, in the image forming apparatus of the invention, an organic photoreceptor drum is mainly used as the photoreceptor drum 23 and a main ingredient of a surface of the organic photoreceptor is a resin. For this reason, the surface may easily deteriorate due to a chemical operation of ozone generated by the corona discharge caused by the charging device. However, since the deteriorated surface portion is worn out by a scratch operation of the cleaning unit 29, the deteriorated surface portion is removed gradually but reliably. Therefore, a problem of deterioration of the surface caused by ozone is actually solved, and the charged potential obtained by a charging operation can be stably maintained over a long period of time.

According to the electrophotographic process unit 21, a toner image is transferred onto a recording medium by executing a series of operations including formation of an electrostatic latent image by electric charging and exposure, formation of the toner image by developing of the electrostatic latent image, transfer of the toner image onto the recording medium, and cleaning of the surface of the photoreceptor drum 23 according to the rotation driving of the photoreceptor drum 23, and the recording medium is fed to the fixing portion 22.

The fixing portion 22 includes: a fixing roller 30 that is provided to be rotatably driven around an axis thereof and has a heating portion (not shown) therein; a pressure roller 31 that is pressed against a surface of the fixing roller 30 and is provided to be rotatably driven around an axis thereof; and a temperature sensor 32 that is provided to face the surface of the fixing roller 30 and detects the surface temperature of the fixing roller 30. As the heating portion (not shown) provided in the fixing roller 30, for example, a heater is used. In addition, the amount of power supplied to the heater is controlled by a control unit (not shown) so that the surface temperature of the fixing roller 30 is maintained in a predetermined temperature according to a result of detection made by the temperature sensor 32. According to the fixing portion 22, the recording medium which is obtained in the electrophotographic process unit 21 and on which the toner image has been transferred is supplied to a pressure-contact portion between the fixing roller 30 and the pressure roller 31. Then, the toner image is fixed by pressing and heating the recording medium while the recording medium is passing through the pressure-contact portion by rotation driving of the fixing roller 30 and the pressure roller 31, such that a recording medium on which image recording has been completed is obtained.

According to the image forming section 3, a recording medium on which a high-quality image is formed can be obtained over a long period of time and continuously by transferring a toner image corresponding to image document information onto a recording medium fed from the paper feed unit 2, heating an pressing the recording medium, and fixing the toner image onto the recording medium.

The discharge section 4 includes a fourth conveyance path 34 that is used to supply an image-record-completed recording medium, which is obtained in the fixing portion 22 of the image forming section 3, to reversing rollers 36*a* and 36*b* to be described later; the reversing rollers 36*a* and 36*b* that change the transport direction of the image-record-completed recording medium; a fifth conveyance path 35 that is used to transport the image-record-completed recording medium to a catch tray (not shown) provided outside the image forming apparatus 1 or a sixth conveyance path 37; and a sixth conveyance path 37 that is used to transport the image-record-completed recording medium to the third conveyance path 33 again. Here, the reversing rollers 36*a* and 36*b* are provided to be able to inversely rotate around axes thereof and to be in pressure-contact with each other. An end of the image-record-completed recording medium supplied to the compressed part of the reversing rollers 36*a* and 36*b* through the fourth conveyance path 34 is inserted between the reversing rollers 36*a* and 36*b* by forward-direction rotation of the reversing rollers 36*a* and 36*b*. Then, the image-record-completed recording medium is transported through the fifth conveyance path 35 by opposite-direction rotation of the reversing rollers 36*a* and 36*b*. In addition, in the case when an image is recorded on only one surface of a recording medium, the recording medium is discharged through the fifth conveyance path 35 to a catch tray (not shown), which is provided outside the image forming apparatus 1, in a direction indicated by an arrow A by an operation of a switching gate (not shown). In addition, in the case when images are formed on both surfaces of a recording medium, the recording medium is transported from the fifth conveyance path 35 to the sixth conveyance path 37 by an operation of a switching gate (not shown) and is then reversed. Then, the recording medium is transported to the image forming section 3 through the third conveyance path 33 such that transfer and fixing of a toner image are performed.

The document reading section 5 includes a document supply portion 38 and an image reading portion 39. The document supply portion 38 includes: a document tray 40 on which a document is placed; a document regulating plate 41 that feeds a document; a curved conveyance path 42 that transports a document such that an image surface of the document is reversed; and a protective mat 43 provided on a contact surface of the document supply portion 38 and a document platen (platen glass) 44 to be described later. On the document tray 40, a document is placed such that the image surface of the document is positioned upward. The document regulating plate 41 feeds a document to the curved conveyance path 42 one by one. The curved conveyance path 42 transports a document right above the document platen 44 while reversing the document such that the image surface of the document is positioned downward. In addition, the document regulating plate 41 mainly protects the document platen 44 formed of platen glass According to the document supply portion 38, a copy operation is started by inputting print conditions, such as the number of sheets of paper, the print magnification, and the paper size, with a condition input key and then pressing a start key on an operation panel (not shown) disposed in a front portion of an outer case of the image forming apparatus 1. In addition, a document placed on the document tray 40 with the image surface positioned upward is automatically transported one by one, is processed such that the image surface is positioned downward while being transported, and is then transported right above a document platen 45. Then, while the document is passing above the document platen 45, image document information of the document is read by the image reading portion 39 which will be described later. Then, the document passing above the document platen 45 is discharged to a catch tray (not shown), which is provided outside the image forming apparatus 1, by the discharge roller 49.

The image reading portion 39 includes: the document platen 44 on which a document automatic transport of which is not possible is placed to read the image document information; the document platen 45 which is provided to be spaced apart from the document platen 44 in the sub-scanning direction and which allows a document, of which automatic transport from the document tray 40 is possible, to pass therethrough and reads the image document information while the document is passing; a light source unit 46 provided to be able to move in a direction (sub-scanning direction) parallel to surfaces of the document platens 44 and 45; a mirror unit 47 that guides reflected light from the document to a CCD read unit 48 described later; and the CCD read unit 48 that converts the reflected light from the document into an electric signal.

The light source unit 46 includes: a light source 46*a*; a recessed reflector (not shown) that condenses illumination light for reading, which is emitted from the light source 46*a*, into a predetermined reading position of the document platen 44 or 45; a slitter (not shown) which allows only the reflected light from the document to selectively pass therethrough; and a mirror 46*b* which reflects the reflected light from the document at 90°. The light source unit 46 emits the illumination light for reading onto the document and supplies the light reflected from the document to the mirror unit 47.

The mirror unit 47 includes a pair of mirrors 47*a* and 47*b* disposed such that reflecting surfaces of the mirrors 47*a* and 47*b* are perpendicular to each other. An optical path of the reflected light from the document supplied from the light source unit 46 is changed at 180° by the mirrors 47*a* and 47*b*, and the reflected light from the document is guided to the CCD read unit 48.

The CCD read unit 48 includes an imaging lens 48*a* that makes reflected light from the mirror unit 47 imaged and a CCD image sensor 48*b* that outputs an electric signal corresponding to the light imaged by the imaging lens 48*a*. The reflected light incident on the imaging lens 48*a* from the mirror unit 47 is imaged, and the image is converted into an electric signal by the CCD image sensor 48*b*. Then, image document information as the electric signal is inputted to the light scanning unit 25 through a control section (not shown), and an image corresponding to the image document information is formed.

According to the image reading portion 39, the image document information of the document placed on the document platen 44 or 45 is acquired as reflected light from the document by irradiation of light from the light source unit 46, and the reflected light is guided to the CCD read unit 48 through the mirror unit 47 and is then converted into image document information on an electric signal. Image processing is performed on the information under a condition set beforehand and the information is transmitted to the light scanning unit 25 of the image forming section 3, such that an image is formed.

Figure 7:
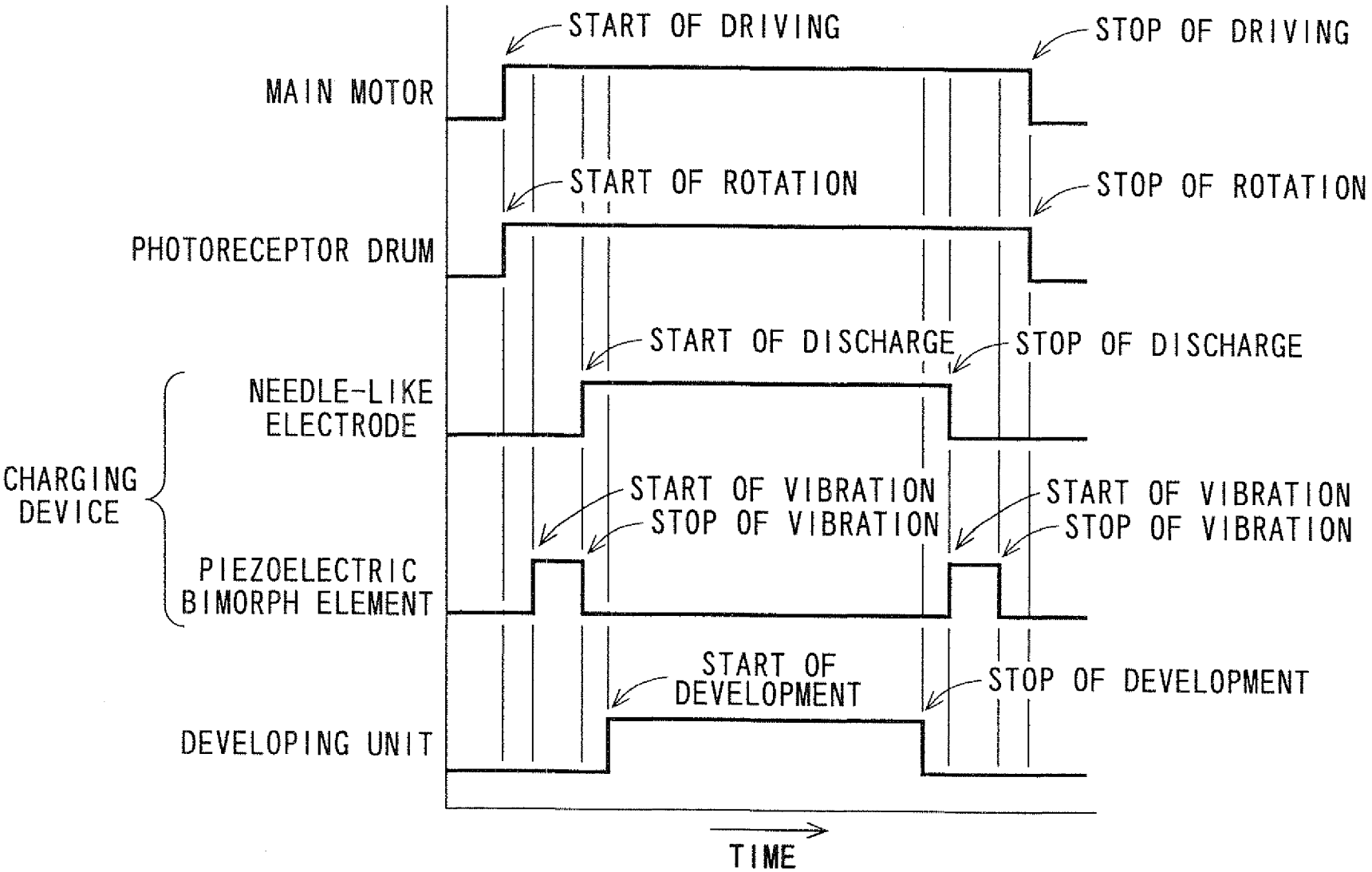
FIG. 7 is a view showing the timing of an operation in the image forming apparatus.

FIG. 7 is a view showing the timing of an operation in the image forming apparatus 1. In the image forming apparatus 1, when a main motor serving as a driving source of the entire apparatus starts driving, the photoreceptor drum 23 starts rotating around a rotary axis thereof. Then, when an alternating voltage is applied from the driving power source 106 to the piezoelectric bimorph element 100 through the harness lines 104 and 105, the piezoelectric bimorph element 100 starts vibrating. Although a time for which the piezoelectric bimorph element 100 is made to vibrate depends on the type, amount, and the like of the contaminants adhering to the surface of the plate-like grid electrode 52, the contaminants can be sufficiently removed by making the piezoelectric bimorph element 100 vibrate for about 1 second.

Then, vibration of the piezoelectric bimorph element 100 is stopped by stopping application of a voltage to the piezoelectric bimorph element 100 and at the same time, application of a high voltage to the needle-like electrode 51 is started. Thus, when the high voltage is applied to the needle-like electrode 51, corona discharge occurs to electrically charge the surface of the photoreceptor drum 23, and the plate-like grid electrode 52 controls the charged potential.

As described above, by making the piezoelectric bimorph element 100 vibrate when the surface of the photoreceptor drum 23 is not electrically charged and the plate-like grid electrode 52 does not control the charged potential at timing before application of a high voltage to the needle-like electrode 51 starts, the contaminants adhering to the surface of the plate-like grid electrode 52 can be removed in a state where degradation of the charged potential controllability of the plate-like grid electrode 52 for controlling the charged potential of the surface of the photoreceptor drum 23 is suppressed.

Then, a developing operation of the developing unit 26 is started to execute forming an image on a recording medium. Then, after the developing operation of the developing unit 26 is stopped, application of a high voltage to the needle-like electrode 51 is stopped. Thus, when the application of a high voltage to the needle-like electrode 51 is stopped, corona discharge stops to make electric charging of the surface of the photoreceptor drum 23 stopped, and the plate-like grid electrode 52 stops controlling the charged potential. Thus, when the application of a high voltage to the needle-like electrode 51 is stopped, an alternating voltage is applied to the piezoelectric bimorph element 100. Then, the piezoelectric bimorph element 100 starts vibrating to continue the vibration for about 1 second and then stops.

As described above, by making the piezoelectric bimorph element 100 vibrate not only before the application of a high voltage to the needle-like electrode 51 starts but also after the application of a high voltage to the needle-like electrode 51 is stopped, it is possible to improve the capability of removing the contaminants adhering to the surface of the plate-like grid electrode 52 while maintaining the state where degradation of the charged potential controllability of the plate-like grid electrode 52 with respect to the surface of the photoreceptor drum 23 is suppressed.

EXAMPLES

Hereinafter, the invention will be specifically described through examples.

Example 1

A plate-like grid electrode base was formed by performing fine processing on a plate (size 20 mm×360 mm×0.1 mm (thickness)) formed of stainless steel (SUS304). Then, a rectangular plate-like piezoelectric bimorph element was formed by using a part of the plate-like grid electrode base as a base portion which is an electrode layer. In this case, the piezoelectric bimorph element was formed by coating lead zirconate titanate (PZT) made of ceramics, which is a piezoelectric material, on both sides of the base portion in the thickness direction and performing a baking process at 1100 to 1150° C. for six hours. In addition, the length of the piezoelectric bimorph element in the longitudinal direction thereof was set to 3.7 mm (a rate of the length of the piezoelectric bimorph element in the longitudinal direction to the length of the plate-like grid electrode in the longitudinal direction: 1.0%). The plate-like grid electrode manufactured as described above was used as a grid electrode of a charging device in an image forming apparatus (product name: AR625, made by sharp Corporation). In addition, the piezoelectric bimorph element was made to vibrate at timing after application of a voltage to the needle-like electrode, which is a discharge electrode, was stopped and after the charged potential control of the plate-like grid electrode was stopped. In addition, a voltage applied to the piezoelectric bimorph element was set to DC 70 V and a frequency was set to 100 Hz.

Example 2

Example 2 was the same as Example 1 except that the timing at which the piezoelectric bimorph element was made to vibrate was set before application of a voltage to the needle-like electrode was started.

Example

Example 3 was the same as Example 1 except that the timing at which the piezoelectric bimorph element was made to vibrate was set to both timing before application of a voltage to the needle-like electrode was started and after the voltage application was stopped.

Comparative Example 1

Comparative example 1 was the same as Example 1 except that the piezoelectric bimorph element was not formed in the plate-like grid electrode. In Comparative example 1, since the piezoelectric bimorph element is not formed, the plate-like grid electrode does not vibrate.

<Discharge Test>

Under conditions of the room temperature and the low humidity (15% RH), an aging test was performed by applying a high voltage to the charging device for a period corresponding to the number of sheets of paper of 300,000 in the A4 size. In this test, the charged potential of a surface of a photoreceptor drum was set to −630 V in an early stage. A electric potential increase value with respect to the initial charged potential was measured, and the grade of the electric potential increase was determined on the basis of the following standards.

Excellent; The electric potential increase value is 40 V or less.

Good: The electric potential increase value is 41 V or more and 80 V or less.

Not bad: The electric potential increase value is 81 V or more and 120 V or less.

Poor: The electric potential increase value is 121 V or more.

<Evaluation on Rust and Nitrogen Oxide Adhesion>

After the discharge test, the surface of the plate-like grid electrode was observed visually and with a microscope. For the evaluation on rust, a case in which rust was generated on the surface of the plate-like grid electrode was assumed to be 'Presence' and a case in which rust was not generated was assumed to be 'Absence'. In addition, for the evaluation on nitrogen oxide adhesion, the grade of nitrogen oxide adhesion was determined on the basis of the following standards.

Excellent: The percentage of the area, in which a nitrogen oxides adheres, to the total area of a peripheral surface surrounding one slit hole of a grid electrode is less than 10%.

Good: The percentage of the area, in which a nitrogen oxides adheres, to the total area of a peripheral surface surrounding one slit hole of a grid electrode is 10% or more and 20% or less.

Not bad: The percentage of the area, in which a nitrogen oxides adheres, to the total area of a peripheral surface surrounding one slit hole of a grid electrode is 20% or more and 40% or less.

Poor: The percentage of the area, in which a nitrogen oxides adheres, to the total area of a peripheral surface surrounding one slit hole of a grid electrode is 40% or more.

The evaluation results are shown in Table 1. As is apparent from Table 1, in Comparative example 1 in which the piezoelectric bimorph element is not formed in the plate-like grid electrodes rust was generated on the surface of the plate-like grid electrode, lots of nitrogen oxides adhering to the surface of the plate-like grid electrode, and an increase in electric potential was very large. On the other hand, in Example 1 to Example 3, rust was not generated on the surface of the plate-like grid electrode, the adhesion amount of nitrogen oxides was small, and the increase in electric potential was small. This is because contaminants, such as nitrogen oxides, adhering to the surface of the plate-like grid electrode, can be easily removed by vibration of the piezoelectric bimorph element in Example 1 to Example 3.

Moreover, in Example 3 in which the piezoelectric bimorph element is made to vibrate in both cases of before application of a voltage to the needle-like electrode is started and after the application of a voltage is stopped, the adhesion amount of nitrogen oxides was smallest and the increase in electric potential was also small. This is because the capability of removing contaminants, such as nitrogen oxides, adhering to the surface of the plate-like grid electrode was improved by increasing the frequency at which the piezoelectric bimorph element vibrates. Furthermore, in Example 1 to Example 3, when the piezoelectric bimorph element vibrates to make the plate-like grid electrode vibrate, there was no contact between the plate-like grid electrode and the photoreceptor drum.

TABLE 1

| | Piezoelectric bimorph element | | | Driving | Discharge test | | Evaluations on rust and adhered matters | |
|---|---|---|---|---|---|---|---|---|
| | Shape | Length (mm) | Vibration timing | frequency (Hz) | Electric potential increase value (V) | Determination on electric potential increase | Rust | Adhesion of nitrogen oxide |
| Example 1 | Rectangular | 3.7 | After discharge is stopped | 100 | 45 | Good | Absence | Not bad |
| Example 2 | Rectangular | 3.7 | Before discharge is started | 100 | 49 | Good | Absence | Not bad |
| Example 3 | Rectangular | 3.7 | Before start of discharge and after stop of discharge | 100 | 33 | Excellent | Absence | Good |
| Comparative example 1 | — | — | — | — | 132 | Poor | Presence | Poor |

Then, a test of checking the shape of a piezoelectric bimorph element and the length of the piezoelectric bimorph element in the longitudinal direction thereof was done.

Example 4

Example 4 is the same as Example 1 except that the surface shape of a piezoelectric bimorph element has a tuning fork shape.

Example 5

Example 5 is the same as Example 1 except that the length of a piezoelectric bimorph element in the longitudinal direction thereof was set to 7.4 mm (a rate of the length of the piezoelectric bimorph element in the longitudinal direction to the length of a plate-like grid electrode in the longitudinal direction: 2.1).

Example 6

Example 6 is the sane as Example 1 except that the length of a piezoelectric bimorph element in the longitudinal direction thereof was set to 11.1 mm (a rate of the length of the piezoelectric bimorph element in the longitudinal direction to the length of a plate-like grid electrode in the longitudinal direction: 3.1%).

Evaluation was performed according to the method described above, and the results are shown in Table 2. As is apparent from Table 2, in the case where the surface shape of the piezoelectric bimorph element was the tuning fork shape, it could be seen that the capability of removing contaminants, such as nitrogen oxides, adhering to the plate-like grid electrode and the capability of suppressing an increase in electric potential were obtained. In addition, it could be seen that the length of the piezoelectric bimorph element in the longitudinal direction affected the capability of removing contaminants, such as nitrogen oxides, adhering to the plate-like grid electrode and the capability of suppressing the increase in electric potential. Furthermore, in Example 4 to Example 6, when the piezoelectric bimorph element vibrates to make the plate-like grid electrode vibrate, there was no contact between the plate-like grid electrode and the photoreceptor drum.

TABLE 2

| | Piezoelectric bimorph element | | | Driving | Discharge test | | Evaluations on rust and adhered matters | |
|---|---|---|---|---|---|---|---|---|
| | Shape | Length (mm) | Vibration timing | frequency (Hz) | Electric potential increase value (V) | Determination on electric potential increase | Rust | Adhesion of nitrogen oxide |
| Example 4 | Tuning fork | 3.7 | After discharge is stopped | 100 | 18 | Excellent | Absence | Excellent |
| Example 5 | Rectangular | 7.4 | After discharge is stopped | 100 | 24 | Excellent | Absence | Excellent |
| Example 6 | Rectangular | 11.1 | After discharge is stopped | 100 | 42 | Good | Absence | Not bad |

In addition, in cases of using the plate-like grid electrode in Example 1 and Comparative example 1, the actual print test was done to 100,000 sheets of paper to check the quality of an image. In the case of the plate-like grid electrode formed of stainless steel in Comparative example 1, pale white muscle was seen in a half-tone image. However, in Example 1, the half-tone image was uniform and the unevenness did not occur.

As described above, in the case of the plate-like grid electrode in which the piezoelectric bimorph element is formed, contaminants, such as nitrogen oxides, adhering to the surface of the plate-like grid electrode, can be easily removed by vibration. Therefore, it is possible to suppress degradation of the charged potential controllability of the plate-like grid electrode occurring due to the contaminants adhering to the Surface of the plate-like grid electrode. In addition, since it can be prevented that corrosion, such as rust, occurs due to contaminants adhering to the surface of the plate-like grid electrode and serving as a core, it is possible to further suppress the degradation of the charged potential controllability of the plate-like grid electrode. As a result, since the charged potential controllability of the plate-like grid electrode is maintained over a long period of time, the charged potential of the surface of the photoreceptor can be maintained in a proper range over a long period of time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging device comprising:

a discharge electrode to which a voltage is applied to electrically charge a surface of a photoreceptor; and a grid electrode provided between the discharge electrode and the photoreceptor in order to control a charged potential of the surface of the photoreceptor, wherein the grid electrode is plate-shaped, wherein the grid electrode has a vibrating portion that vibrates itself to make the grid electrode vibrate, and wherein the vibrating portion is a piezoelectric bimorph element in which two piezoelectric elements formed of a piezoelectric material in a plate shape are bonded to opposite sides of a portion of the grid electrode in a thickness direction of the grid electrode, and wherein the vibrating portion vibrates when voltages mutually reverse in phase are applied to the piezoelectric elements.

2. The charging device of claim 1, wherein the vibrating portion is adapted to vibrate before application of a voltage to the discharge electrode is started or after the application of a voltage is stopped.

3. The charging device of claim 1, wherein the vibrating portion is adapted to vibrate in both cases of before application of a voltage to the discharge electrode is started and after the application of a voltage is stopped.

4. The charging device of claim 1, wherein the vibrating portion is formed in a tuning fork shape.

5. The charging device of claim 4, wherein vibration of the tuning fork shaped vibrating portion causes the grid electrode to vibrate in resonance with the vibrating portion.

6. The charging device of claim 1, wherein the piezoelectric elements are formed of piezoelectric ceramics.

7. The charging device of claim 1, wherein a length of the two piezoelectric elements in a longitudinal direction thereof in the vibrating portion is set such that when the vibrating portion vibrates, an entire surface of the grid electrode vibrates.

8. An image forming apparatus comprising:

a photoreceptor having a surface on which an electrostatic latent image is formed;

the charging device of claim 1, for electrically charging the surface of the photoreceptor;

an exposure section that irradiates signal light based on image information onto the photoreceptor surface which is electrically charged to thereby form the electrostatic latent image;

a developing section that develops the electrostatic latent image on the photoreceptor surface to thereby form a toner image;

a transfer section that transfers the toner image onto a recording medium; and a fixing section that fixes the toner image transferred onto the recording medium.

9. The charging device of claim 1, wherein the grid electrode is shaped so that the portion of the grid electrode to which the piezoelectric elements are bonded is generally rectilinear in shape, with three of the four sides of the rectilinear shaped portion free to move with respect to the remainder of the grid electrode.

10. The charging device of claim 1, wherein a voltage applied to the piezoelectric elements is an alternating current voltage having a frequency of 100 Hz to 1600 Hz.

11. The charging device of claim 1, wherein a thickness of each of the piezoelectric elements is approximately 5 to 8 times a thickness of the portion of the grid electrode to which they are attached.

12. The charging device of claim 1, wherein the grid electrode comprises a plate of material that has been patterned to include a plurality of apertures, and wherein the piezoelectric elements are bonded to opposite sides of a portion of the plate of material located at an end of the plate of material.

13. The charging device of claim 12, wherein a base portion of the grid electrode to which the piezoelectric elements are bonded is generally rectilinear in shape, and wherein the plate of material forming the grid electrode is patterned so that apertures are formed on three sides of the rectilinear shaped base portion.

14. The charging device of claim 12, where only a single vibrating portion is provided on the grid electrode.

* * * * *